United States Patent [19]

Maki-Hoimela et al.

[11] 4,318,807

[45] Mar. 9, 1982

[54] METHOD AND APPARATUS FOR DROP-SORTING OF TIMBER

[75] Inventors: Veijo Maki-Hoimela, Helsinki, Finland; Alpo Rysti, Friisilantie 36, 02240 Espoo 24, Finland

[73] Assignee: Alpo Rysti, Espoo, Finland

[21] Appl. No.: 114,217

[22] Filed: Jan. 22, 1980

[30] Foreign Application Priority Data

Sep. 18, 1979 [FI] Finland ..... 792902

[51] Int. Cl.[3] ..... B07C 5/14

[52] U.S. Cl. ..... 209/517; 209/912

[58] Field of Search ..... 209/517, 518, 519, 520, 209/521, 912; 198/680, 678, 369

[56] References Cited

U.S. PATENT DOCUMENTS 2,902,150 9/1959 Rambo ..... 209/521

3,581,891 6/1971 Rysti ..... 209/517 X

FOREIGN PATENT DOCUMENTS 188138 3/1964 Sweden ..... 209/517

*Primary Examiner*—Allen N. Knowles

*Attorney, Agent, or Firm*—Fitzpatrick, Cella, Harper & Scinto

[57] ABSTRACT

A device for drop-sorting timber comprises a series of hooks for carrying timber pieces and a conveying system for advancing the hooks to drop positions over timber compartments. The hooks can be pivoted at selected positions to drop their timber pieces and are so formed that while being advanced the open end of a hook is effectively closed by the next following hook to prevent premature discharge.

14 Claims, 5 Drawing Figures

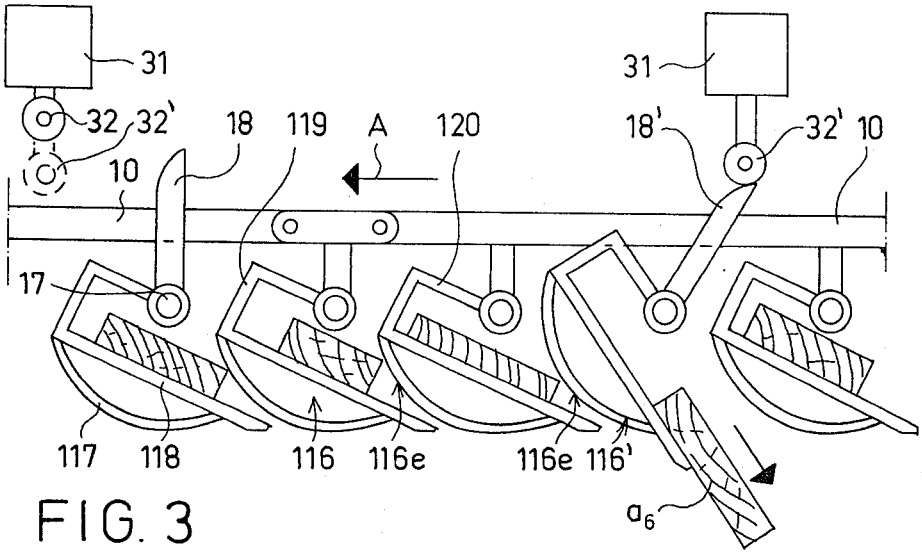
FIG. 3
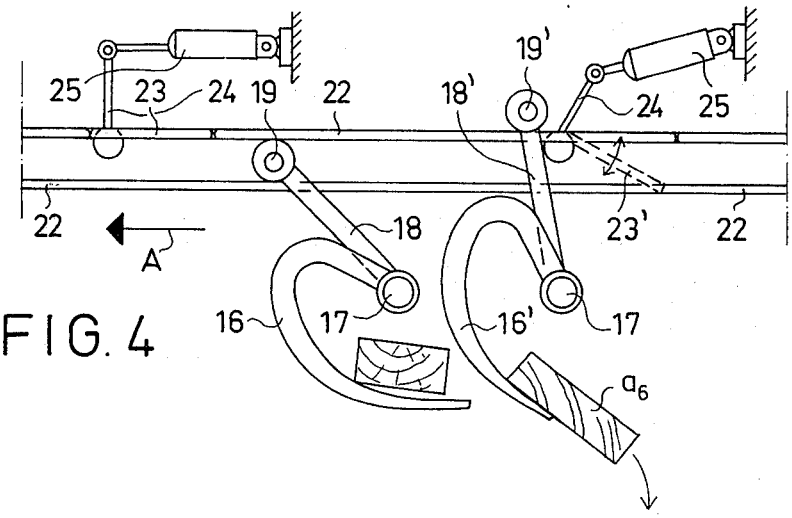
FIG. 4
FIG. 5
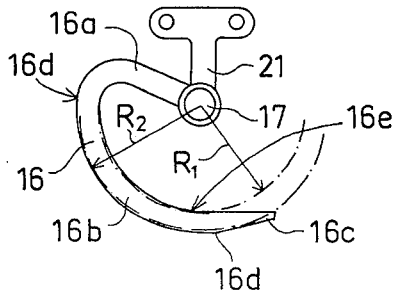

METHOD AND APPARATUS FOR DROP-SORTING OF TIMBER

BACKGROUND OF THE INVENTION

1. Field of the Invention

The present invention relates to the sorting of timber, and more particularly to a method and apparatus for sorting timber by conveying it transversely on supporters of a sorting conveyor and turning the supporters to cause the timber pieces to drop from the supports into a sorting compartment or the like.

2. Description of the Prior Art

A conventional method of timber-sorting employs a chain conveyor on top of which timber is conveyed above sorting compartments. From the chain conveyor the timber pieces are, according to their type, dropped into various compartments. In known chain conveyors it is normal to use L-shaped supporters, for advancing the timber pieces, and the timber pieces are dropped by turning the supporters or an obstacle located in association with them, according to an address given to it above the sorting compartments.

The supporting parts of the conveyors are straight or may be turned upwards in order to prevent the timber pieces from dropping due to acceleration or decleration forces as the conveyor starts or stops. In spite of this feature, a drawback in the conveyors known so far has been that, as the sorting conveyor starts or stops, timber pieces that are slippery because of ice, for instance, do not remain on the supporters but fall prematurely from the same, thus giving rise to operating difficulties or causing timber pieces to enter the wrong compartments.

A drawback in the supporting parts of previously known sorting conveyors has also been that the dropping angle is the same were the timber pieces are broad or narrow. As the gliding distance of a broader timber piece is longer than the gliding distance of a narrower timber piece, the timing and placing of the drop become inaccurate even though a steep dropping angle is used.

SUMMARY OF THE INVENTION

We have conceived and contribute by the present invention a method and apparatus by which we are able to eliminate the drawbacks mentioned above and for attaining advantages that will more closely be described below, the principal characteristic feature of our invention residing in the fact that in the sorting conveyor we employ supporting hooks that have been given a curved shape in such a way that the outer part of the closed side of a supporting hook prevents the timber piece located on the adjacent supporting hook from dropping by sufficiently closing the open side of the adjacent supporting hook.

In practice, several important advantages are attained in accordance with the invention. Thus, transporting curves are positioned near each other which contributes to a high transporting capacity even at low conveyor speeds. As a conveyor in accordance with the invention stops or starts, inertia forces cannot cause slippery or icy timber pieces to drop from the conveyor. To a broader timber piece the invention gives a steeper initial dropping angle than to a narrower piece. Due to this fact both borad and narrow pieces are released from the curve approximately at the same time and consequently the dropping takes place accurately. In accordance with the invention, it is also possible to feed timber to either side of the sorting conveyor, on top of it or below it.

There has thus been outlined rather broadly the more important features of the invention in order that the detailed description thereof that follows may be better understood and in order that the present contribution to the art may be better appreciated. There are, of course, additional features of the invention that will be described hereinafter and which will form the subject of the claims appended hereto. Those skilled in the art will appreciate that the conception upon which this disclosure is based may readily be utilized as a basis for the designing of other structures for carrying out the several purposes of the invention. It is important, therefore, that the claims be regarded as including such equivalent constructions as do not depart from the spirit and scope of the invention.

BRIEF DESCRIPTION OF THE DRAWINGS

Specific embodiments of the invention have been chosen for purposes of illustration and description, and are shown in the accompanying drawings, forming a part of the specification wherein:

FIG. 3 illustrates such an application of the invention in which there are straight supporting sections in the hooks of the drop-sorting conveyor;

FIG. 4 illustrates an embodiment of the releasing device of the conveyor hooks; and FIG. 5 illustrates a conveyor hook according to the present invention.

DESCRIPTION OF THE PREFERRED EMBODIMENT

Figure 1:
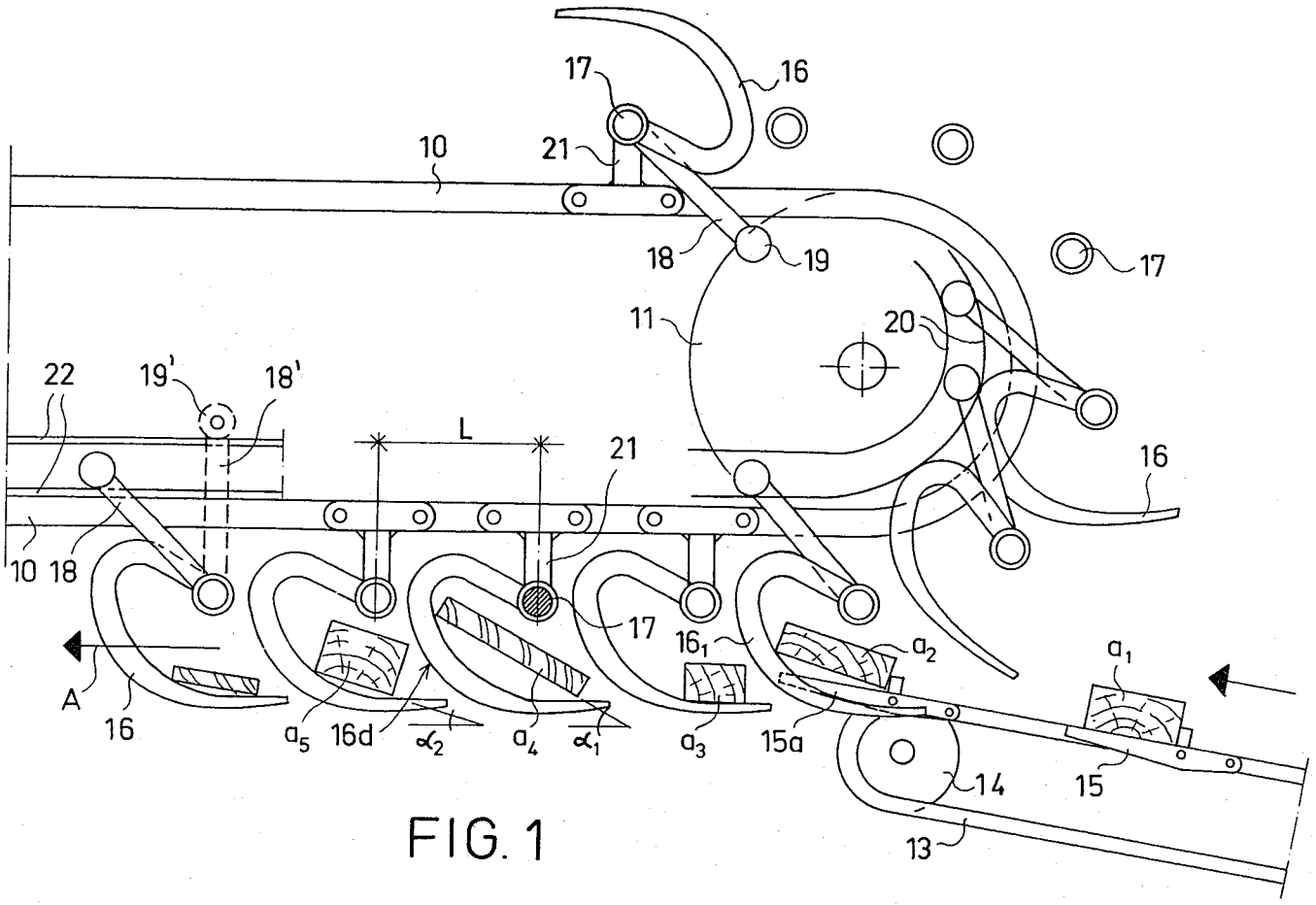
FIG. 1 is a schematic side view of a drop-sorting conveyor, to which timber pieces are brought with a spur conveyor.
Figure 2:
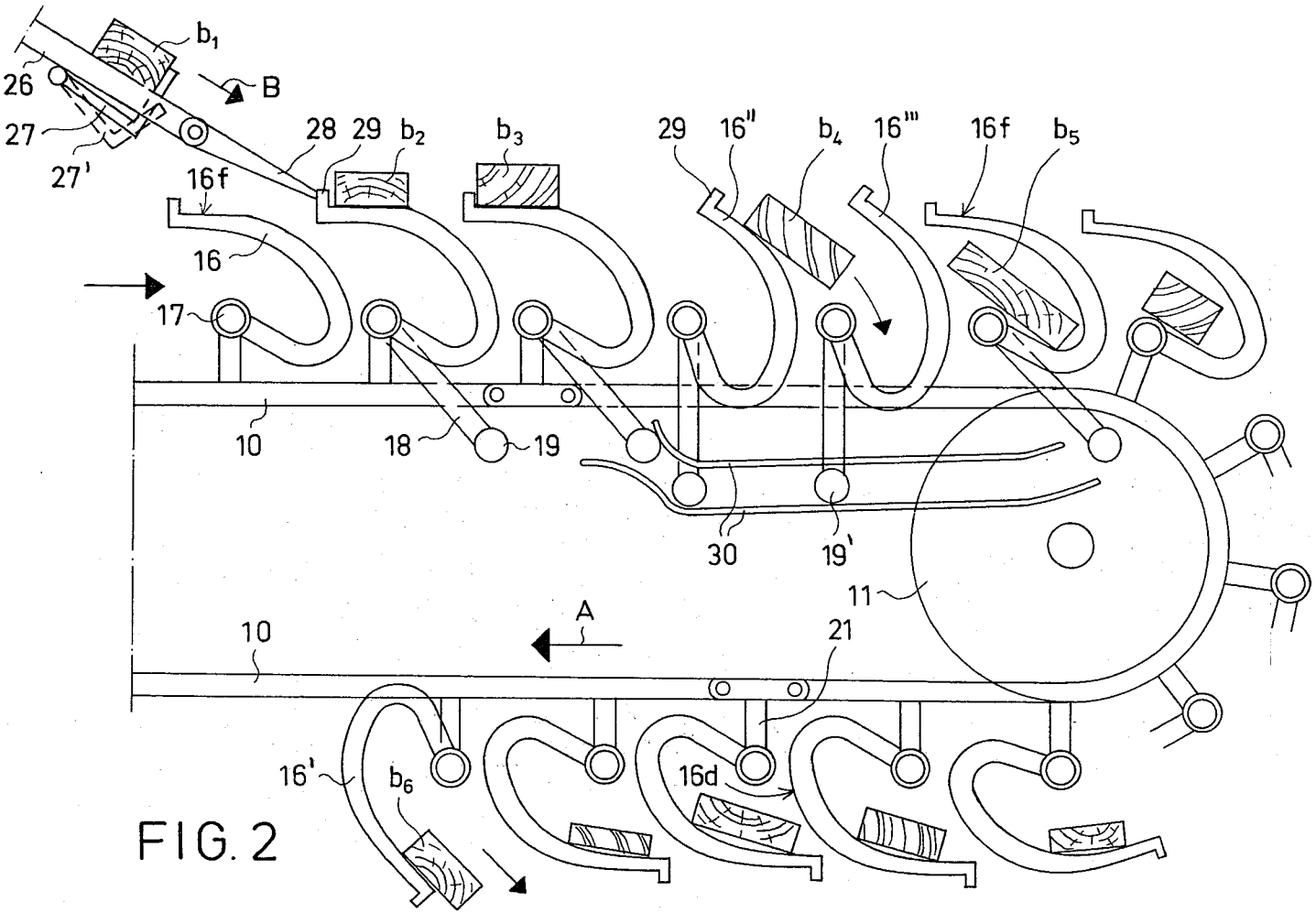
FIG. 2 illustrates such a drop-sorting conveyor in accordance with the invention, at which the timber pieces are measured on its upper course.

As shown in the drawing, and especially FIGS. 1 to 3 thereof, the drop-sorting conveyor comprises two or more parallel conveyor chains 10 reeved around a pulley 11. Conveyor hooks 16, illustrated as being generally U-shaped, are fastened by means of arms 21 to the conveyor chains at relatively short distances and are pivoted to the arms 21 by pivot pins 17 in such a way as to allow hooks 16 pivot in the vertical plane, each hook having a section which approaches its pivot pin in a downward direction when viewed at the lower course, i.e. below the pulley 11, and also being formed with a straight pointed section at its free end. We provide two or more parallel conveyor chains and, for each timber piece, the same number of parallel hooks 16.

The structure of conveyor hooks 16 is shown in FIG. 5. Each hook comprises a section **16*a* pointed obliquely upwards when the hook is freely suspended, a curved section 16*b* merging with section 16*a* and an end section 16*c*. The curved section 16*b* is essentially bounded by two circles $R_1$ and $R_2$, whose center point is the pivoting point 17** of the hook.

As shown in FIG. 1, chain conveyor 13 with stops 15, its pulley 14 being in line with the track of hooks 16, convey timber pieces $a_1$ so that, at pulley 14, stops **15*a***, when starting to travel downwardly, present the timber piece $a_2$ to a conveyor hook $16_1$. Depending on the width of the timber pieces a, their inclinations as to the horizontal will be different, the inclination angle $\alpha_1$ of a broader timber piece $a_4$ being greater than the inclination angle $\alpha_2$ of a narrower timber piece $a_5$.

FIG. 4 illustrates an example of equipment with which conveyor hooks 16 can be made to pivot around pivot 17, as the hook in question arrives above the sorting compartment (not shown) to which the timber piece supported by hooks 16 should be dropped. In FIG. 4, hook 16' is turned to such a position that timber piece $a_6$ is dropped to the sorting compartment below. To facilitate turning of conveyor hooks 16, they are each fitted with an arm 18, at the top end of which there is a wheel or caster 19 running in respective guide rail 22. When a timber piece is intended to be dropped to a certain compartment, an impulse is given to a cylinder 25 located above this compartment, whereupon the cylinder, by means of levers 24, turns flap 23 to position 23'. Now flap 23' guides wheel 19, as they run in guiding rails 22, to position 19' above top guiding rails 22, and the parallel conveyor hooks turn to position 16'.

Releasing systems different from the one depicted above can also be used. An example is illustrated in FIG. 3. In this embodiment, above each sorting compartment there is an actuating cylinder 31 that has a roller at the end of its piston rod. As an impulse is transmitted to actuating cylinder 31, the roller at the end of the piston rod moves to position 32', at which it interfers with advancing arm 18 connected with hooks 116, and, as the conveyor moves forward, the arm is turned to position 18' and the supporting hook to position 116', at which the timber piece $a_6$ is let free to drop to the compartment below.

FIG. 2 illustrates such an application of the invention in which timber pieces b are brought to the upper course of drop-sorting conveyor 10. For this purpose, above the drop conveyor there has been arranged one or more positioning devices 26 with rotating supporting hooks 27. As these supporting hooks turn to position 27', the timber piece is allowed to slide along slope 28 to be then supported by the plane-formed outer section **16*f* of supporting hooks 16. Shoulder 29 assures that timber pieces $b_2$ and $b_3$ will stay on outer sections 16*f* of the supporting hooks. There can be more than one measuring platform 26; they can be synchronized to operate in such a way as to prevent two timber pieces from being laid on one hook 16. As rollers 19 come to guiding rails 30, the hooks turns to position 16'', whereat timber piece $b_4$ moves into the next hook 116'''. Thus, as the conveyor chain 10 turns around pulley 11, conveyor hooks 16 move to the lower course of conveyor 10** where they are above the sorting compartments and move in the direction of arrow A.

Supporting hooks illustrated in FIG. 3 differ from hooks illustrated in the other Figs. in that hooks 116 have a straight supporting section 118 and under it a curved section 117. The straight supporting section 118 is connected with parts 119 and 120 to pivot 17, by means of which it is fastened to supporting chain 10.

In a procedure in accordance with the invention, the essential feature of the operation of supporting hooks 16; 116 is that the outer surface **16*d*; 116*e*, essentially of the shape of an arc of a circle, of the curved section 16*b*, 117 of the hooks, acts as the part that closes the preceding hook in such a way that the inertia forces or small friction between the timber piece and the hooks cannot in any situation allow or cause the piece to fall from the supporting hooks. As far as hooks 16', 116' are concerned, in FIGS. 3 and 4 the supporting hook preceding hook 16', 116' stays closed, because of the following supporting hook, even in the situation in which hook 16', 116'** turns and drops the timber piece $a_6$ to the sorting compartment.

Another essential feature of the hooks shown in FIGS. 1, 2 and 4 is that in them the inclination angle $\alpha_1$ of broad timber pieces (for instance timber piece $a_4$ in FIG. 1) is, during transportation, larger than the inclination angle of the narrowest timber pieces, which allows even the broadest timber pieces to be dropped essentially as fast as the narrowest, which makes it possible to improve the accuracy of dropping. It is also important that the distance between the support hooks can be made very short and the efficiency of the conveyor consequently improved, if the speed of conveyor 10 is not changed. On the other hand, the speed of conveyor 10 can be slowed down without losses in the efficiency of the conveyor, which improves the reliability of the equipment.

We believe that the construction and operation of our novel apparatus and the practice of our novel method will now be understood and that the several advantages there of will be fully appreciated by those persons skilled in the art.

We claim:

1. A method of sorting timber pieces in which the pieces are conveyed transversely on supporting means in the form of hooks associated with a conveyor and formed with arcuate closed sections, characterized by positioning the hooks so that the arcuate closed sections of each hook faces and effectively closes the open sections of the next adjacent preceeding hook in the direction of travel along at least a portion of the run of the conveyor, loading at least some of the hooks with a timber piece by positioning the piece within the confines of the surface defining the interior of the respective hooks, advancing said loaded hooks along a conveyor run and causing said timber pieces to fall from said loaded hooks by pivoting selected hooks effectively to open the same at selected locations along said run.

2. A method in accordance with claims 1 further characterized by providing the center region of said hooks with a curved shaped wherefore broad timber pieces will have a larger dropping angle ($\alpha_1$) than the corresponding dropping angle ($\alpha_2$) of narrower timber pieces.

3. A method according to any of claims 1 or 2, further characterized by positioning the supporting hooks so that the distance between two adjancent hooks is essentially as great as the width of the broadest timber piece that can obliquely be supported on the supporting hooks.

4. The method according to any of claims 1 or 2, further characterized by pivoting said hooks to open position at the start of a conveyor run and loading the timber pieces on the hooks.

5. The method according to any of claims 1 or 2, further characterized by providing the conveyor with an upper and lower run and positioning the timber pieces on said hooks on said upper run.

6. Apparatus for the sorting of timber pieces comprising: means for conveying timber pieces transversely relative to timber receiving means, said conveying means including hook shaped timber supporters having closed arcuate sections, means mounting said hook shaped supporters for pivotal movement to discharge loaded timber pieces, said mounting means being positioned to locate the closed arcuate sections of each hook-shaped supporter adjacent the open portion of the next preceding supporter to prevent loaded timber pieces from falling prematurely from said supporters.

7. Apparatus according to claim 6 wherein the arcuate sections of each hook-shaped timber supporter is formed on a radius coinciding with the pivot point about which each respective supporter moves to discharge position.

8. Apparatus according to either claims 6 or 7, wherein said supporters are generally U-shaped and are connected to said mounting means by a section which approaches said mounting means in a downward direction, the other end of said supporters having a straight pointed section.

9. Apparatus according to claim 8, wherein said conveying means has upper and lower runs and said apparatus includes means for loading a timber piece on each of said supporters as it advances along said upper run.

10. Apparatus according to claim 9, wherein said supporters are formed with means preventing the timber pieces from falling prematurely from said supporters.

11. Apparatus according to claim 9, wherein said loading means are disposed relative to the upper run of said conveyor means so as to load the timber pieces on the outer surface of said supporters, said supporters are formed with shoulders for preventing the timber pieces from falling prematurely from said supporters, and said conveying means include guide means for shifting each supporter as it advances along its upper run so that the timber piece carried on the outer surface thereof moves to the inner surface of the next adjacent preceding supporter prior to reaching its discharge position.

12. Apparatus according to claim 9, wherein said loading means are disposed relative to the upper run of said conveyor means so as to load the timber pieces on the outer surface of said supporters, said supporters are formed with shoulders for preventing the timber pieces from falling prematurely from said supporters, and said conveying means include guide means for shifting each supporter as it advances along its upper run so that the timber piece carried on the outer surface thereof moves to the inner surface of the next adjacent preceding supporter prior to commencing movement along its lower run during which it discharges its respective timber piece.

13. The method according to claim 3, further characterized by pivoting said hooks to the open position at the start of a conveyor run and loading the timber pieces on the hooks.

14. The method according to claim 3, further characterized by providing the conveyor with an upper and lower run and positioning the timber pieces on said hooks on the upper run.

* * * * *